US012545981B2

(12) United States Patent
Kim et al.

(10) Patent No.: US 12,545,981 B2
(45) Date of Patent: Feb. 10, 2026

(54) HIGH-STRENGTH STEEL HAVING SUPERIOR DUCTILITY, AND MANUFACTURING METHOD THEREFOR

(71) Applicant: POSCO, Pohang-si (KR)

(72) Inventors: Sang-Ho Kim, Pohang-si (KR); Woo-Gyeom Kim, Pohang-si (KR)

(73) Assignee: POSCO, Pohang-si (KR)

( * ) Notice: Subject to any disclaimer, the term of this patent is extended or adjusted under 35 U.S.C. 154(b) by 758 days.

(21) Appl. No.: 17/783,956

(22) PCT Filed: Dec. 1, 2020

(86) PCT No.: PCT/KR2020/017377
§ 371 (c)(1),
(2) Date: Jun. 9, 2022

(87) PCT Pub. No.: WO2021/125623
PCT Pub. Date: Jun. 24, 2021

(65) Prior Publication Data

US 2023/0002871 A1 Jan. 5, 2023

(30) Foreign Application Priority Data

Dec. 16, 2019 (KR) ..... 10-2019-0168003

(51) Int. Cl.

| | |
|---|---|
| ***C22C 38/12*** | (2006.01) |
| ***C21D 8/02*** | (2006.01) |
| ***C21D 8/0221*** | (2026.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/14*** | (2006.01) |

(52) U.S. Cl.
CPC ..... *C22C 38/12* (2013.01); *C21D 8/0226* (2013.01); *C22C 38/001* (2013.01); *C22C 38/02* (2013.01); *C22C 38/04* (2013.01); *C22C 38/06* (2013.01); *C22C 38/14* (2013.01); *C21D 2201/05* (2013.01); *C21D 2211/005* (2013.01); *C21D 2211/009* (2013.01)

(58) Field of Classification Search
CPC ..... C22C 38/12; C22C 38/001; C22C 38/02; C22C 38/04; C22C 38/06; C22C 38/14; C21D 2211/005; C21D 2211/009; C21D 8/0226; C21D 2201/05; C21D 1/613; C21D 6/005; C21D 8/0205; C21D 8/021; C21D 8/0263; C21D 9/46; C21D 8/0273; Y02P 10/20
See application file for complete search history.

(56) References Cited

U.S. PATENT DOCUMENTS

| | | | | |
|---|---|---|---|---|
| 2008/0131305 | A1 | 6/2008 | Okitsu | |
| 2016/0160309 | A1 | 6/2016 | Allain et al. | |
| 2018/0312954 | A1* | 11/2018 | Yasui | C22C 38/20 |
| 2022/0389548 | A1* | 12/2022 | Kim | C23C 2/12 |

FOREIGN PATENT DOCUMENTS

| | | | | |
|---|---|---|---|---|
| CN | 101065509 | A | | 10/2007 |
| EP | 2787098 | A1 | | 10/2014 |
| IN | 334432 | | | 1/2014 |
| JP | H11-92858 | A | | 4/1999 |
| JP | 2007-119857 | A | | 5/2007 |
| JP | 2007-119899 | A | | 5/2007 |
| JP | 2007-246985 | A | | 9/2007 |
| JP | 2008-169468 | A | | 7/2008 |
| JP | 2010-084188 | A | | 4/2010 |
| JP | 2010-229528 | A | | 10/2010 |
| JP | 2011-102409 | A | | 5/2011 |
| JP | 2016-079476 | A | | 5/2016 |
| JP | 5994819 | B2 | | 9/2016 |
| JP | 6007968 | B2 | | 10/2016 |
| JP | 2018-009243 | A | | 1/2018 |
| KR | 10-2001-0060760 | A | | 7/2001 |
| KR | 10-2003-0055540 | A | | 7/2003 |
| KR | 10-2009-0069871 | A | | 7/2009 |
| KR | 20090069872 | A | * | 7/2009 |
| KR | 10-0914590 | B1 | | 8/2009 |
| KR | 10-2016-0104077 | A | | 9/2016 |
| KR | 10-2017-0071461 | A | | 6/2017 |
| KR | 10-1928207 | B1 | | 12/2018 |
| KR | 10-2019-0035422 | A | | 4/2019 |
| WO | 2011/099408 | A1 | | 8/2011 |

OTHER PUBLICATIONS

English Machine Translation of KR 20090069872 A (Year: 2025).*
Extended European Search Report dated Nov. 15, 2024, issued in corresponding European Patent Application No. 20901014.9.
Chinese Office Action dated Feb. 13, 2023, issued in corresponding Chinese Patent Application No. 202080086946.8.
International Search Report dated Mar. 3, 2021 issued in International Patent Application No. PCT/KR2020/017377 (with English translation).

* cited by examiner

*Primary Examiner* — Anthony J Zimmer
(74) *Attorney, Agent, or Firm* — Morgan Lewis & Bockius LLP

(57) ABSTRACT

The present invention is to provide a steel having high strength properties and also having superior elongation, and a manufacturing method therefor.

3 Claims, No Drawings

HIGH-STRENGTH STEEL HAVING SUPERIOR DUCTILITY, AND MANUFACTURING METHOD THEREFOR

CROSS-REFERENCE OF RELATED APPLICATIONS

This application is the U.S. National Phase under 35 U.S.C. § 371 of International Patent Application No. PCT/KR2020/017377, filed on Dec. 1, 2020, which in turn claims the benefit of Korean Application No. 10-2019-0168003, filed on Dec. 16, 2019, the entire disclosures of which applications are incorporated by reference herein.

TECHNICAL FIELD

The present disclosure relates to a high-strength steel material, and manufacturing method therefor, and more particularly, to a high-strength steel material having superior ductility, and a manufacturing method therefor.

BACKGROUND ART

Structural steel materials used for ships, offshore structures, building structures, etc. tend to require high strength properties for use thereof. In order to reduce the weight of a structure while satisfying the structural strength required for the steel structure, the strength of the steel material should be excellent.

On the other hand, in the process of manufacturing a steel structure, curved forming is usually accompanied by bending, but if ductility is insufficient, tears may occur in the steel plate during curved forming. When the steel plate is torn by such a curved forming, a problem in that the manufacturing time is significantly long may occur.

In addition, the exterior wall of the hull may be torn due to a stranding or collision or between ships during ship operations. In this case, it may lead to flooding or sinking, resulting in damage to life and property. In particular, if the ship's cargo is crude oil or petroleum products, it may lead to serious marine environmental accidents.

In this way, in order to prevent the steel plate from being torn due to a collision during ship operations or curved forming during manufacturing of a steel structure, and to prevent the exterior wall of the hull from being torn in the event of a collision with an external object, the ductility of the steel material applied to the exterior wall must be high enough to absorb impact energy.

However, since strength and ductility are in inverse proportion to each other, it may not be easy to manufacture a steel plate having excellent strength and ductility simultaneously. Nevertheless, many efforts have been made to solve the problems as mentioned above.

For example, in Patent Document 1, the average grain size of ferrite as the main phase is 3 to 12 μm, the ferrite fraction is controlled to be 90% or more, and the average equivalent circle diameter of the second phase is controlled to be 0.8 μm or less. Thereby, a steel plate having excellent collision absorption properties with having a tensile strength of 490 MPa or more and a uniform elongation of 15% or more is described.

Patent Document 1 describes a steel plate having a tensile strength of 490 MPa or more and a uniform elongation of 15% or more. However, it does not clearly describe the total elongation secured by the disclosure, although the total elongation (or fracture elongation) is more related to the fracture of the steel plate than the uniform elongation.

Patent Document 2 describes a steel material in which the structure consists of ferrite and a hard second phase, the volume fraction of ferrite is 75% or more in the total thickness of the plate, the hardness is 140 Hv or more, 160 or less, and the average grain size is 2 μm or more by applying manufacturing conditions consisting of front cooling, air colling, and rear cooling in the cooling process after rolling. Thereby, it may provide a steel material having a tensile strength of 490 MPa or more and a uniform elongation of 20% or more.

Patent Document 2 has excellent tensile strength of 490 MPa or more and uniform elongation of 20% or more. However, even if the uniform elongation is excellent, the total elongation is not necessarily excellent, so it is unclear as to what the extent of the total elongation corresponding to the fracture elongation is.

In Patent Document 3, in order to increase the energy absorbing capacity during collision, it is described of the thick steel plate having a microstructure consisting of a main phase of ferrite and a second phase mainly composed of pearlite. Further, there is described of the thick steel plate that the average dislocation density of ferrite is lowered to a certain lever or less while the hardness, fraction, average area, and average peripheral length of the second phase satisfy predetermined conditions. To this end, a manufacturing method in which a steel material is heated to the high temperature higher than a general reheating temperature, then controlled rolling is performed, and air cooled or soft water cooled is disclosed.

Patent Document 4 describes a method for manufacturing a steel plate having high strength and high ductility that minimizes the difference in hardness between the surface layer and the center at thickness, by satisfying a ferrite area fraction of 80 to 95% and pearlite area fraction of 5 to 20%, and by limiting the grain size, aspect ratio, and dislocation density of ferrite. Thereby, it may to provide a steel plate having a tensile strength of 490 MPa or more, and an elongation of 23 to 40% or more depending on the thickness of the plate.

Patent Documents 3 and 4 can manufacture a steel plate having a tensile strength of 490 MPa or more and excellent ductility. However, in order to control S to 0.003% or less, it is inevitable to accompany the load in a steel making process. In addition, the reheating temperature is outside of the normal range, so difficulties in manufacturing the steel plate are expected.

PRIOR TECHNICAL LITERATURE (Patent Document 1) Korea Patent No. 10-0914590
(Patent Document 2) Korea Patent Publication No. 10-2016-0104077
(Patent Document 3) Japan Patent No. 5994819
(Patent Document 4) Japan Patent No. 6007968

DISCLOSURE

Technical Problem

An aspect of the present disclosure is to provide a steel material having high strength properties and also having superior ductility, and a manufacturing method therefor.

An object of the present disclosure is not limited to the above description. A person skilled in the art would have no difficulty in gaining an understanding of further objects of the present disclosure from the overall descriptions of the present specification.

Technical Solution

According to an aspect of the present disclosure, a high-strength steel material having superior ductility, by weight %, comprises: carbon (C): 0.14 to 0.17%, silicon (Si): 0.3 to 0.5%, manganese (Mn): 0.9 to 1.2%, phosphorus (P): 0.02% or less, sulfur (S): 0.005% or less, aluminum (Al): 0.01 to 0.06%, titanium (Ti): 0.005 to 0.02%, niobium (Nb): 0.005 to 0.02%, nitrogen (N): 0.002 to 0.006%, and a balance of Fe and other inevitable impurities, a microstructure comprising a complex structure consisting of polygonal ferrite as matrix structure and pearlite as residual structure, wherein a grain size of polygonal ferrite is 4 to 8 μm, and wherein a thickness of the steel material is 15 mm or less.

The fraction of pearlite may be 20 to 30 area %.

The steel material may have a yield strength of 355 MPa or more, a tensile strength of 490 MPa or more, a proportional elongation of 30% or more.

According to another aspect of the present disclosure, a method of manufacturing a high-strength steel material having superior ductility, by weight %, comprises: reheating a steel slab comprising carbon (C): 0.14 to 0.17%, silicon (Si): 0.3 to 0.5%, manganese (Mn): 0.9 to 1.2%, phosphorus (P): 0.02% or less, sulfur (S): 0.005% or less, aluminum (Al): 0.01 to 0.06%, titanium (Ti): 0.005 to 0.02%, niobium (Nb): 0.005 to 0.02%, nitrogen (N): 0.002 to 0.006%, and a balance of Fe and other inevitable impurities at a temperature within a range of 1100 to 1200° C.; rough rolling the reheated steel slab; finish rolling the rough rolled steel slab at finish rolling end temperature of 850 to 950° C. to obtain a rolled steel material having a thickness of 15 mm or less; and air cooling the rolled steel material.

A cooling rate of air cooling may be 1 to 5° C./s.

A cumulative rolling reduction of finish rolling may be 70 to 90%.

Advantageous Effects

According to an aspect of the present disclosure, a steel material having high strength properties and also having superior ductility, and a manufacturing method therefor, may be provided.

BEST MODE FOR INVENTION

Hereinafter, preferred exemplary embodiments in the present disclosure will be described. The exemplary embodiments in the present disclosure may be modified in various forms, and the scope of the disclosure should not be interpreted to be limited to the exemplary embodiments set forth below. These exemplary embodiments are provided in order to describe the present disclosure in more detail to those with ordinary skill in the art to which the present disclosure pertains.

Hereinafter, the present disclosure will be described in detail.

Hereinafter, an alloy composition of the steel of the present disclosure will be described in detail.

In the present disclosure, unless otherwise specified, % indicating the content of each element is based on weight.

According to an aspect of the present disclosure, a steel material having superior ductility, by weight %, comprises: carbon (C): 0.14 to 0.17%, silicon (Si): 0.3 to 0.5%, manganese (Mn): 0.9 to 1.2%, phosphorus (P): 0.02% or less, sulfur (S): 0.005% or less, aluminum (Al): 0.01 to 0.06%, titanium (Ti): 0.005 to 0.02%, niobium (Nb): 0.005 to 0.02%, nitrogen (N): 0.002 to 0.006%, and a balance of Fe and other inevitable impurities.

Carbon (C): 0.14 to 0.17%

Carbon (C) is an element determining tensile strength by affecting the pearlite fraction. Therefore, in the present disclosure in which air cooling is essential instead of water cooling after rolling, a sufficient carbon (C) content is essential to secure tensile strength. That is, 0.14% or more should be added to secure the tensile strength targeted in the present disclosure. On the other hand, if the content thereof exceeds 0.17%, the tensile strength can be secured, but it becomes difficult to secure the ductility targeted in the present disclosure. Since ductility is inversely proportional to the pearlite area fraction, when the carbon (C) content increases, the pearlite increases, which is disadvantageous in securing ductility.

Therefore, the content of the carbon (C) may be 0.14 to 0.17%, more preferably 0.15 to 0.165%.

Silicon (Si): 0.3 to 0.5%

Silicon (Si) is an element that is effective for deoxidation and increases hardenability, so that it should be added in an amount of 0.3% or more to secure tensile strength. However, when the content thereof exceeds 0.5%, the tensile strength is excessively high, and the ductility decreases due to the increase in strength, making it difficult to secure the target elongation in the present disclosure.

Therefore, the content of the silicon (Si) may be 0.3 to 0.5%, more preferably 0.35 to 0.5%.

Manganese (Mn): 0.9 to 1.2%

Manganese (Mn) is an element that increases hardenability, so that it should be added in an amount of 0.9% or more to secure tensile strength. However, when the content thereof exceeds 1.2%, there is a problem in that the tensile strength is too high and the ductility is lowered.

Therefore, the content of the manganese (Mn) may be 0.9 to 1.2%, more preferably 1.0 to 1.2%.

Phosphorus (P): 0.02% or Less

Phosphorus (P) is an impurity that is unavoidably included during the manufacturing process of the steel material, and it is necessary to be minimized due to a reduction of ductility. However, in order to lower the phosphorus (P) content, the load during the steel manufacture process is increased and the steel manufacture costs increase, so the upper limit is limited 0.02%.

Therefore, the content of the phosphorus (P) may be 0.02% or less, more preferably 0.012% or less.

Sulfur (S): 0.005% or Less

Sulfur (S) is an impurity that is unavoidably included during the manufacturing process of steel material, and it is necessary to be minimized because it remarkably degrades a ductility of the steel material by forming MnS. However, in order to lower the sulfur (S) content, the load during the steel manufacture process is increase and the steel manufacture costs increase, so the upper limit is limited 0.005%.

Therefore, the content of the sulfur (S) may be 0.005% or less, more preferably 0.003% or less.

Aluminum (Al): 0.01 to 0.06%

Aluminum (Al), like Si, is an effective element for deoxidation, and should be contained in an amount of 0.01% or more for deoxidation. However, if the content thereof exceeds 0.06%, the toughness of the weld portion may be reduced.

Therefore, the content of the aluminum (Al) may be 0.01 to 0.06%, more preferably 0.02 to 0.04%.

Titanium (Ti): 0.005 to 0.02%

Titanium (Ti) is combined with N to form TiN, which suppresses coarse growth of austenite upon reheating, thereby contributing to the improvement of tensile strength by refining the ferrite grains of the final microstructure. However, when the content thereof exceeds 0.02%, TiN becomes coarse and cannot prevent austenite from growing at high temperature. For this reason, it is impossible to ensure the refinement of ferrite in the final structure, and it becomes difficult to secure the tensile strength and elongation that are targeted in the present disclosure.

Therefore, the content of the titanium (Ti) may be 0.005 to 0.02%, more preferably 0.007 to 0.015%.

Niobium (Nb): 0.005 to 0.02%

Since niobium (Nb) make austenite pancakes during rolling by expanding the non-recrystallization region of austenite, it refines the grains of ferrite in the final microstructure. Thereby, since the tensile strength and elongation of the steel are simultaneously improved, 0.005% or more should be added. However, when the content thereof exceeds 0.02%, there is a problem in that the weldability of the steel is greatly degraded.

Therefore, the content of the niobium (Nb) may be 0.005 to 0.02%, more preferably 0.007 to 0.015%.

Nitrogen (N): 0.002 to 0.006%

Nitrogen (N) suppresses coarse growth of austenite during reheating by forming TiN with Ti, so 0.002% or more should be added. However, when the content thereof exceeds 0.006%, there is a problem in that the surface quality of the steel plate is greatly deteriorated.

Therefore, the content of the nitrogen (N) may be 0.002 to 0.006%, more preferably 0.003 to 0.005%.

The steel material of the present disclosure may include the remainder of iron (Fe) and other inevitable impurities. Unintended impurities may be inevitably incorporated from a raw material or a surrounding environment in the course of a conventional steel manufacturing process, and, thus, may not be excluded. Since these impurities may be known to a person skilled in the ordinary steel manufacturing process, all of these may be not specifically mentioned in the present disclosure.

Hereinafter, a microstructure of the steel of the present disclosure will be described in detail.

In the present disclosure, unless otherwise specified, % indicating the fraction of microstructure is based on area.

The steel material of the present disclosure satisfying the alloy composition described above comprises pearlite of 20 to 30% and the remainder polygonal ferrite as a microstructure, and the grain size of polygonal ferrite may be 4 to 8 μm.

The microstructure may comprise 20 to 30% of pearlite and a remainder of polygonal ferrite.

In order to secure tensile strength in steel having a microstructure consisting of polygonal ferrite and pearlite, the grain size of polygonal ferrite must be significantly fine or the pearlite fraction must be high. In order to make the polygonal ferrite grain size significantly fine, many industrial efforts are required, such as a significantly low reheating temperature or increasing the reduction ratio during rolling. It is significantly difficult to have a ferrite grain size of 2 μm or less through general thick steel plate rolling. In addition, when the ferrite grain size is below a certain level, the uniform elongation is greatly reduced and the total elongation is also reduced accordingly. Therefore, in order to secure the target tensile strength in the present disclosure, the pearlite fraction should be sufficiently high while reduce the ferrite grain size. If the pearlite area fraction is less than 20%, it is difficult to secure the tensile strength targeted in the present disclosure, and if it exceeds 30%, it is difficult to secure the elongation.

It is preferable that bainite is not contained in other structures. When bainites is included, the strength is increased, but it may be difficult to secure the ductility targeted in the present disclosure.

The ferrite grain size may be 4 to 8 μm based on the equivalent circle diameter.

If the ferrite grain size is less than 4 μm, the strength is increased, but it becomes difficult to secure the total elongation due to the decrease of the uniform elongation. On the other hand, if the size exceeds 8 μm, it becomes difficult to secure the tensile strength.

Hereinafter, a steel manufacturing method of the present disclosure will be described in detail.

The steel material according to an aspect of the present disclosure may be manufactured by the process steps of reheating, hot rolling, and cooling a steel slab satisfying the alloy composition as described above.

Reheating

The steel slab satisfying the alloy composition as described above may be reheated to a temperature within a range of 1100 to 1200° C.

The reheating temperature can be determined in terms of austenite coarsening and Nb solid solution. The higher the reheating temperature, the coarser austenite is, and the higher the amount of Nb solid solution increases, which pancakes the austenite during the rolling process. When the reheating temperature exceeds 1200° C., Nb solid solution increases, but austenite becomes too coarse during reheating, so there is a problem in that polygonal ferrite grains are not sufficiently refined in the final microstructure. On the other hand, if the temperature is less than 1100° C., Nb solid solution becomes insufficient, and pancaking of austenite during rolling may not be sufficiently achieved, so there may be a limit to refinement of polygonal ferrite.

The reheating time depends on the thickness of the steel slab. The reheating time is not particularly limited, but in general, heating for about 1 minute per 1 mm of the thickness of the steel slab is sufficient.

Hot Rolling

Hot rolling is performed by dividing into rough rolling and finishing rolling.

Rough Rolling

The reheated slab can be rough rolled immediately after it is extracted from the reheating furnace.

Rough rolling includes widening rolling to secure the width of the final steel sheet, and the slab is rolled to a thickness at which finish rolling starts.

Finish Rolling

The rough rolled steel material can be finish rolled at a finish rolling end temperature of 850 to 950° C.

When the finish rolling end temperature is less than 850° C., the polygonal ferrite grain size in the final structure becomes less than 4 μm based on the equivalent circle diameter. So that, it can secure high strength sufficiently. However, it is difficult to secure the target ductility in the present disclosure due to a decrease in elongation according to an increasing strength. On the other hand, when the temperature exceeds 950° C., the polygonal ferrite grain size exceeds 8 μm based on the equivalent circle diameter, making it difficult to secure the tensile strength targeted in the present disclosure.

The cumulative rolling reduction of the finish rolling may be 70 to 90%.

If the cumulative rolling reduction of the finish rolling is less than 70%, the polygonal ferrite is not sufficiently refined and it is difficult to secure strength, and if it exceeds 90%, it becomes difficult to secure elongation.

Cooling

The rolled steel material can be air cooled at a cooling rate of 1 to 5° C./s. When air cooling is applied, it is advantageous to obtain a microstructure consisting only of polygonal ferrite and pearlite. On the other hand, when water cooling is applied, not only pearlite but also bainite is included as the second phase, so the strength is excessively increased, and the cooling variation for the steel material compared to air cooling deepens, thereby increasing variation in elongation. For the same reason, even with air cooling, if the cooling rate is too fast, the problem as described above may occur, so the upper limit of the cooling rate may be 5° C./s. However, if the air cooling rate is too slow, polygonal ferrite becomes coarse and it is difficult to secure tensile strength. Therefore, the cooling rate must be 1° C./s or more. In addition, since the air cooling rate of the steel plate may be determined according to the thickness of the steel plate, the thickness of the steel plate may be limited to 15 mm or less in order to secure the air cooling rate of the steel plate of 1° C./s or more. In the present disclosure, the steel plate is manufactured through conventional rolling, and the lower limit of the thickness of the steel plate is not limited.

The steel material of the present disclosure manufactured as described above has a yield strength of 355 MPa or more, a tensile strength of 490 MPa or more, and a proportional elongation of 30% or more, and can have excellent ductility while having strength properties.

Hereinafter, the present disclosure will be specifically described through the following Examples. However, it should be noted that the following examples are only for describing the present disclosure in detail by illustration, and are not intended to limit the scope of rights of the present disclosure.

MODE FOR INVENTION

Example

Molten steel having the alloy components shown in Table 1 was manufactured, and it was cast into a steel slab having a thickness of 250 mm through a continuous casting method. The manufactured steel slabs were reheated, rolled, and cooled under the conditions shown in Table 2 to prepare steel plate having a thickness of 11 and 15 mm. For cooling, air cooling and water cooling were applied. In the case of air cooling, the cooling rate satisfies 1 to 5° C./s in steel having a thickness of 15 mm or less. For water cooling, a cooling rate of 18° C./s was applied, and the cooling end temperature was set to about 710° C., and the air cooling conditions to room temperature after accelerated cooling was applied.

TABLE 1

| Steel | Alloy composition (weight %) | | | | | | | | |
|---|---|---|---|---|---|---|---|---|---|
| type | C | Si | Mn | P | S | Al | Ti | Nb | N |
| A | 0.143 | 0.35 | 1.16 | 0.014 | 0.003 | 0.043 | 0.008 | 0.008 | 0.004 |
| B | 0.152 | 0.43 | 1.07 | 0.009 | 0.004 | 0.025 | 0.014 | 0.016 | 0.002 |
| C | 0.158 | 0.36 | 1.08 | 0.016 | 0.004 | 0.036 | 0.011 | 0.013 | 0.005 |
| D | 0.163 | 0.46 | 1.02 | 0.012 | 0.002 | 0.028 | 0.013 | 0.017 | 0.003 |
| E | 0.167 | 0.33 | 0.96 | 0.011 | 0.004 | 0.029 | 0.007 | 0.007 | 0.004 |
| F | 0.131 | 0.35 | 1.12 | 0.013 | 0.003 | 0.033 | 0.009 | 0.011 | 0.003 |
| G | 0.184 | 0.42 | 1.07 | 0.015 | 0.003 | 0.047 | 0.012 | 0.018 | 0.004 |
| H | 0.157 | 0.46 | 1.04 | 0.017 | 0.004 | 0.023 | 0.014 | 0.002 | 0.003 |

TABLE 2

| Specimen no. | Steel type | Steel plate thickness (mm) | Reheating temperature (° C.) | Finish rolling: End temperature (° C.) | Finish rolling: Cumulative rolling reduction (%) | Cooling type |
|---|---|---|---|---|---|---|
| 1 | A | 15 | 1123 | 874 | 75 | Air cooling |
| 2 | B | 15 | 1108 | 886 | 80 | Air cooling |
| 3 | C | 15 | 1119 | 860 | 85 | Air cooling |
| 4 | D | 15 | 1134 | 857 | 80 | Air cooling |
| 5 | E | 15 | 1126 | 883 | 85 | Air cooling |
| 6 | A | 11 | 1168 | 920 | 90 | Air cooling |
| 7 | B | 11 | 1187 | 945 | 85 | Air cooling |
| 8 | C | 11 | 1193 | 939 | 80 | Air cooling |
| 9 | F | 15 | 1116 | 882 | 85 | Air cooling |
| 10 | G | 15 | 1134 | 861 | 85 | Air cooling |
| 11 | H | 15 | 1156 | 894 | 80 | Air cooling |
| 12 | B | 15 | 1238 | 877 | 80 | Air cooling |
| 13 | C | 15 | 1107 | 835 | 85 | Air cooling |
| 14 | D | 15 | 1122 | 870 | 80 | Water cooling |
| 15 | E | 20 | 1115 | 887 | 75 | Air cooling |

In order to analyze the microstructure of the steel plate, a specimen was taken at a point ¼ of the plate thickness from the manufactured steel plate. Thereafter, the specimen was polished and etched with a nital corrosion solution, and then observed under an optical microscope. The average equivalent circle diameter corresponding to the polygonal ferrite grain size, pearlite area fraction, and bainite area fraction were measured using an image analyzer connected to an optical microstructure, and are shown in Table 3.

In addition, a tensile test was performed by taking a tensile specimen from the manufactured steel plate at a point at ¼ of the width of the steel plate. The tensile specimen was processed so that the length of the specimen was parallel to the width direction of the steel plate. According to the rules of the R14B specimen, which is a proportional specimen listed in the Korean Register of Shipping (KR), the specimen width was 25 mm, the specimen thickness was the steel plate thickness, and the gage length was 5.65×√(specimen width× specimen thickness). It was processed as a proportional specimen. Table 3 shows the yield strength, tensile strength and proportional elongation of the processed tensile specimen by performing a tensile test at room temperature.

In Comparative Example 2, the C content was higher than the range of the present disclosure, the pearlite fraction exceeded 30%, and thus the yield strength and tensile strength were excellent. But the ductility was inferior, so that the target elongation in the present disclosure was not secured.

Comparative Example 3 did not satisfy the yield strength and elongation target in the present disclosure because the polygonal ferrite grain size was outside of the scope of the present disclosure due to insufficient Nb content.

Comparative Example 4 satisfied the alloy composition of the present disclosure. But the target elongation in the present disclosure was not secured because the polygonal ferrite grain size was not sufficiently controlled due to the excessively high of the reheating temperature.

In Comparative Example 5, the finish rolling end temperature was outside the scope of the present disclosure, and the polygonal ferrite grain size was too small, so that the proportional elongation was not good.

In Comparative Example 6, water cooling was applied instead of air cooling as a cooling method after rolling, and although pearlite as well as bainite were formed as the second phase, the strength was excellent, but the elongation targeted in the present disclosure was not secured.

In Comparative Example 7, the cooling rate after rolling was insufficient because the thickness of the steel plate exceeded 15 mm, thereby yield strength and tensile strength could not be secured.

TABLE 3

| | | Microstructure | | | Mechanical properties | | | |
|---|---|---|---|---|---|---|---|---|
| Specimen no. | Steel type | Polygonal ferrite grain size (μm) | Pearlite area fraction (%) | Bainite area fraction (%) | Yield strength (MPa) | Tensile strength (MPa) | Proportional elongation (%) | Classification |
| 1 | A | 6.3 | 20 | 0 | 415 | 527 | 35 | Inventive Example 1 |
| 2 | B | 6.7 | 23 | 0 | 385 | 516 | 33 | Inventive Example 2 |
| 3 | C | 5.3 | 25 | 0 | 429 | 531 | 34 | Inventive Example 3 |
| 4 | D | 4.6 | 27 | 0 | 433 | 536 | 32 | Inventive Example 4 |
| 5 | E | 6.0 | 2 | 0 | 381 | 530 | 32 | Inventive Example 5 |
| 6 | A | 6.9 | 21 | 0 | 383 | 518 | 38 | Inventive Example 6 |
| 7 | B | 7.8 | 24 | 0 | 373 | 509 | 36 | Inventive Example 7 |
| 8 | C | 7.6 | 24 | 0 | 377 | 516 | 34 | Inventive Example 18 |
| 9 | F | 5.8 | 17 | 0 | 367 | 483 | 39 | Comparative Example 1 |
| 10 | G | 5.4 | 33 | 0 | 424 | 548 | 27 | Comparative Example 2 |
| 11 | H | 8.2 | 25 | 0 | 352 | 512 | 29 | Comparative Example 3 |
| 12 | B | 8.6 | 25 | 0 | 365 | 527 | 28 | Comparative Example 4 |
| 13 | C | 3.8 | 24 | 0 | 433 | 541 | 28 | Comparative Example 5 |
| 14 | D | 4.2 | 18 | 6 | 431 | 559 | 25 | Comparative Example 6 |
| 15 | E | 9.7 | 28 | 0 | 348 | 485 | 33 | Comparative Example 7 |

As shown in Tables 1 to 3, Inventive Examples 1 to 8 satisfies all of the alloy composition and manufacturing conditions of the present disclosure, thereby satisfying all of the yield strength, tensile strength, and proportional elongation targeted in the present disclosure.

However, in Comparative Example 1, the C content was lower than the range of the present disclosure, the pearlite fraction was less than 20%, and the tensile strength did not reach 490 MPa.

Hereinabove, the present disclosure has been described in detail by the exemplary embodiments, but other exemplary embodiments having different forms are possible. Therefore, the technical spirit and scope of the claims set forth below are not limited by the exemplary embodiments.

The invention claimed is:

1. A steel material, by weight %, consisting of: carbon (C): 0.14 to 0.17%, silicon (Si): 0.3 to 0.5%, manganese (Mn): 0.9 to 1.2%, phosphorus (P): 0.02% or less, sulfur(S): 0.005% or less, aluminum (Al): 0.01 to 0.06%, titanium (Ti): 0.005 to 0.02%, niobium (Nb): 0.005 to 0.02%, nitrogen (N): 0.002 to 0.006%, and a balance of Fe and other inevitable impurities, a microstructure comprising polygonal ferrite as matrix structure and pearlite as residual structure, wherein a grain size of polygonal ferrite is 4 to 8 μm, and wherein a thickness of the steel material is 15 mm or less.

2. The steel material having superior ductility of claim 1, wherein the fraction of pearlite is 20 to 30 area %.

3. The steel material having superior ductility of claim 1, wherein the steel material has a yield strength of 355 MPa or more, a tensile strength of 490 MPa or more, a proportional elongation of 30% or more.

* * * * *